United States Patent [19]

Drobish

[11] Patent Number: 4,533,069

[45] Date of Patent: Aug. 6, 1985

[54] PUMP-TYPE DISPENSER

[75] Inventor: James L. Drobish, Wyoming, Ohio

[73] Assignee: The Procter & Gamble Company, Cincinnati, Ohio

[21] Appl. No.: 546,343

[22] Filed: Oct. 31, 1983

[51] Int. Cl.[3] ..... B65D 37/00

[52] U.S. Cl. ..... 222/209; 222/259; 222/386.5; 222/260

[58] Field of Search ..... 222/386, 386.5, 256, 222/257, 259, 260, 209, 213

[56] References Cited

U.S. PATENT DOCUMENTS

| | | | |
|---|---|---|---|
| Re. 31,408 | 10/1983 | Czech et al. | 222/341 |
| 2,898,007 | 8/1959 | Gassaway | 222/215 |
| 3,088,636 | 5/1963 | Spatz | 222/213 |
| 3,768,705 | 10/1973 | Spatz | 222/213 |
| 3,854,826 | 12/1974 | Adams | 401/188 |
| 4,154,371 | 5/1979 | Kolaczinski et al. | 222/212 |
| 4,301,948 | 11/1981 | Czech et al. . | |
| 4,323,175 | 4/1982 | Eckert | 222/256 |
| 4,402,431 | 9/1983 | Weigner et al. | 222/207 |
| 4,413,759 | 11/1983 | Mettenbrink | 222/213 |
| 4,474,313 | 10/1984 | Sieverding | 222/386 |

FOREIGN PATENT DOCUMENTS

| | | |
|---|---|---|
| 875780 | 10/1942 | France . |
| 197618 | 1/1965 | Sweden . |

*Primary Examiner*—Joseph J. Rolla
*Assistant Examiner*—Andrew Jones
*Attorney, Agent, or Firm*—Richard C. Witte; John V. Gorman; Ronald J. Snyder

[57] ABSTRACT

A pump-type dispenser for a fluid product is described which incorporates a single outlet check valve and a follower piston slidably mounted therewithin. The dispenser includes an axially extending bore of a tubular container body for housing a product to be dispensed and having an upper end from which the product is dispensed and an open lower end. The follower piston is slidably mounted within the lower end of the bore of the container body to support the product thereabove. The piston is constructed of resilient material and comprises a face portion adapted to contact the product and a peripherally attached sidewall. The sidewall is formed with at least one peripheral contact band conforming to the shape of the cross section of the bore, and having the peripheral contact band dimensioned to provide an interference fit within the bore which exerts a predetermined normal force against the inner surfaces of the bore in static condition, thereby establishing a predetermined frictional resistance to movement of the piston within the bore. The predetermined frictional resistance is substantially equivalent in both upward and downward directions of axial displacement of the piston within the bore.

7 Claims, 4 Drawing Figures

PUMP-TYPE DISPENSER

TECHNICAL FIELD

This invention relates to a pump-type dispensing package for a fluid product, and, more particularly, to a dispensing package which includes a single outlet check valve in direct communication with the packaged product and a follower piston slidably mounted within the pump-type package.

BACKGROUND ART

Much work has been directed to dispensing packages for liquids and other fluent masses. Swedish Pat. No. 197,618, which issued to K. H. Lundberg on Jan. 21, 1965, from an application filed June 21, 1961, for example, discloses a receptacle for paste-like or liquid material comprising a transparent tube equipped on one end with a tapering flexible hollow head having a slit opening therethrough. In one version of the receptacle described by Lundberg, the transparent tube is equipped with a plunger provided with a number of ring-shaped flanges extending obliquely from the plunger in a backward direction relative to the hollow head. The ring-shaped flanges extending in a backward direction permit the plunger to be easily moveable toward the hollow head, but moveable in the opposite direction only " . . . by overcoming the significantly increased friction." In use, a portion of the hollow head is manually squeezed together thereby reducing the volume within the head and discharging material through the slit. Upon release of the squeezing force, the slit closes as the hollow head returns to its original volume, thus creating a slight underpressure within the receptacle and thereby moving the plunger in a direction toward the hollow head.

A container adapted to hold semi-solid or fluent masses and embodying dispensing features for controlling the discharge of such masses is disclosed in U.S. Pat. No. 3,088,636, which issued to Walter B. Spatz on May 7, 1963. The Spatz '636 dispenser describes a container having a pliant plastic head capable of decreasing the effective volume within the container, a self-closing discharge opening which acts as a check valve, and a one-way follower device. Inward deflection of the pliant head decreased the volume within the dispenser and effects an opening of the discharge outlet, thus allowing the fluent material to pass therethrough. A one-way latch mechanism is attached to the central rear portion of the follower and includes a plurality of circumferentially spaced latch fingers which extend laterally in an outward and rearward direction and function to engage the inner wall of the container to prevent rearward motion of the follower device within the container. Upon release of the pressure on the head, the lips of the discharge outlet are closed and the head resiliently returns to its original configuration, thus creating a partial vacuum within the container and allowing atmospheric pressure to act on the one-way follower device pressing it forwardly within the container.

U.S. Pat. No. 3,768,705, which issued to Walter B. Spatz on Oct. 30, 1973, is also directed to a dispenser for fluent masses and shows a one-way follower slidingly mounted within a pliant elastic container behind the fluent material contained therein. A butterfly check-valve is disposed in the outlet of the elastic container and opens to allow dispensing in response to squeezing of the container at any point. Subsequent to the removal of a squeezing force on the elastic container, the outlet check-valve closes, thus preventing air from entering the container as the pliant container walls return to their original position, thereby creating a negative pressure within the container. The follower comprises a one-way latch device similar to that described in the Spatz '636 patent having rearwardly disposed latch fingers which prevent movement of the follower in the rearward direction. As in Spatz '636 ambient air at atmospheric pressure moves the follower forwardly within the container as the result of the vacuum created after a dispensing operation.

A pump-action dispensing package for liquids and paste-like products is taught in U.S. Pat. No. 4,301,948, which issued to Joachim Czech and Hans Sieghart on Nov. 24, 1981. This dispenser features a container closed at its lower end by a slidable piston and provided at its upper end with a head member which includes a variable-volume pump chamber. The pump chamber itself is isolated from the bulk of the product in the container by a first check valve adapted to open only towards the pump chamber, and is isolated from an extended outlet passage by a second check valve adapted to open only towards the outlet. Exterior manual pressure exerted on the pump head piston decreases the volume in the pump chamber and forces product through the second check valve and outlet, thereby dispensing a portion of the product. Upon removal of said force, the pump chamber returns to its original volume thereby creating a partial vacuum within the pump chamber and causing the second check valve to close and the first check valve to open, thus permitting product from the container to enter the pump chamber and replace the mass of product which had been dispensed.

Despite all of the prior work done in this area, as evidenced by the above-cited patents, there remain problems of complexity of the dispensers, assembly of the parts, reliability of function, and excessive cost. The packages of the prior art require complex multiple valving structures, and/or multi-part follower devices, and/or correspondingly complex assembly operations, and still are not always reliable in operation. Further, heretofore pump dispensers have required either a one-way follower device or a set of at least two check valves to operate properly. Such shortcomings result in dispensers which are necessarily complex, inconvenient, and expensive.

DISCLOSURE OF THE INVENTION

It is an object of this invention to obviate the above-described problems.

It is an object of the present invention to provide an economical and reliable dispensing package requiring a minimum of parts and assembly operations.

It is an object of the present invention to provide an improved pump dispenser which does not require two check valves for proper operation.

It is also an object of the present invention to provide an improved dispensing package with a one-piece integrally formed follower piston which can be functionally designed in relation to the other parts of said package to optimize the functional characteristics and convenience thereof.

It is another object of the present invention to provide an improved pump dispenser for fluids which does not require a one-way follower device to operate properly.

It is still another object of the present invention to provide a pump dispensing package which features added convenience without added cost in relation to other conventionally known dispensing packages.

In accordance with one aspect of the present invention, there is provided a dispenser for a fluid product, wherein the product is housed in an axially extending bore of a tubular container body having an upper end in direct communication with a discharge passageway and an open lower end. The dispenser includes a follower piston slidably mounted within the lower end of the tubular container body to retain the product thereabove, a check valve dispensing outlet located adjacent the discharge passageway which permits fluid product to be dispensed outwardly therethrough when product pressure within the dispenser attains a predetermined dispensing pressure, and finger activated pump means to vary the product pressure within the dispenser. The follower piston comprises a face portion and a peripherally attached sidewall, that sidewall being formed with at least one peripheral contact band which conforms to the shape of the cross section of the bore of the container body and which is dimensioned so as to provide an interference fit within the bore which exerts a predetermined normal force against the inner surfaces of the bore thereby establishing a predetermined frictional resistance to displacement of the piston within the bore. The predetermined frictional resistance is substantially equivalent in both upward and downward directions of axial movement within the bore, and is greater than the force applied to the piston by the required dispensing pressure and less than the force applied to the piston by pressure imbalance caused by the establishment of vacuum within the dispenser. Such frictional resistance characteristics allow the pressure within the dispenser to be built up to the required dispensing pressure without movement of the piston toward the open end of the bore, while allowing ambient air pressure to move the piston toward the upper end when pressure within the dispenser is reduced to below atmospheric.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF THE INVENTION

Figure 1:
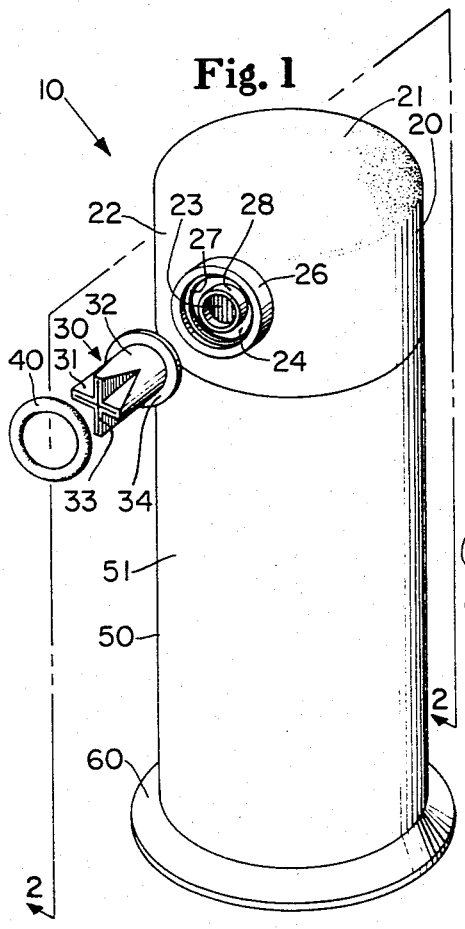
FIG. 1 is a partially exploded perspective view of a preferred embodiment of the dispenser of the present invention.
Figure 2:
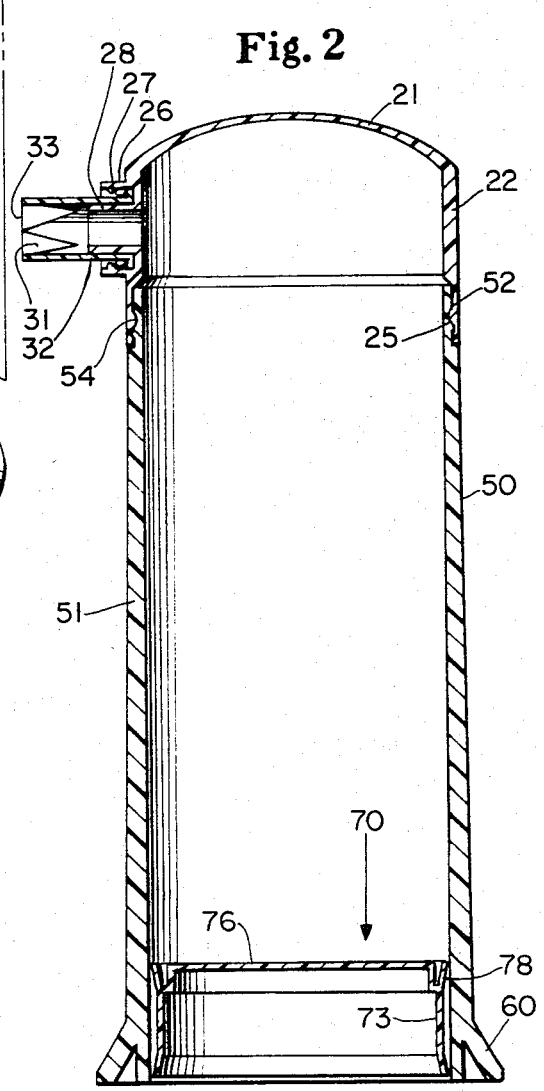
FIG. 2 is an enlarged vertical cross-sectional view of the dispenser of FIG. 1 taken along the line 2—2 of FIG. 1.

Referring now to the drawings, wherein like numerals indicate the same elements throughout the views, FIGS. 1 and 2 illustrate in detail the package 10 which includes a container body 50, a self-sealing check valve dispensing outlet 30, a resilient top 20, and a follower piston 70. The product to be dispensed, not shown, fills the package 10 interior and can generally be any flowable substance or liquid. Such flowable substances generally have a viscosity of less than 500,000 centipoises.

The container body 50 is constructed of any substantially rigid material (such as metal, paperboard, plastic, or composite structures combining two or more of these materials) and comprises a tubular portion 51 open at both ends with an upper recessed exterior portion 52 having a snap-fitment groove 54 formed therein. The tubular portion 51 preferably has a cylindrical axial bore therethrough, but the inner cross section of such bore can be of any desired shape (such as square, rectangular, or oval). A cylindrical bore is preferred, however, because it is difficult to establish a seal around a piston having a different configuration.

While absolute rigidity of tubular portion 51 is not essential, substantial rigidity is preferred because the volume of fluid product dispensed from the package will be affected during any particular dispensing operation by changes of volume permitted by non-rigid structures and, moreover, rigidity helps insure substantially parallel inner wall surfaces for proper sealing with the follower piston 70, which will be discussed in greater detail below. Plastic (e.g., polypropylene, polyacrylonitrile, or polyethylene terephthalate) is a preferred material for tubular portion 51 as it provides expediency and ease in the manufacturing process.

Formed about the bottom outer periphery of container body 50 is an integral base 60 extending downwardly and outwardly from the outer surfaces of tubular portion 51, the lower distal surface of which is coplanar with and outwardly spaced from the lowermost end of tubular portion 51.

Resilient top 20 is preferably constructed of a resilient material (e.g., polypropylene, polyethylene terephthalate, polyacrylonitrile, elastomers, or polymer composites), and has a rounded top section 21 of polypropylene with a smooth outer finish. Rounded top section 21 is preferably formed with a thickness in the range of approximately 0.43–0.51 mm (0.017–0.020 inches) and with a radius of curvature of approximately 51 mm (2.0 inches) when used with a container body 50 having an outside diameter of approximately 43.8 mm (1.725 inches). A rounded top section 21 exhibiting such dimensions will require approximately 2.38 kg (5.25 lbs.) of force to deform it enough to dispense one gram of fluid product (300,000 cp. viscosity) from package 10, and will create a vacuum within package 10 of approximately 0.26 kg/cm$^2$ [3.5 lbs. per square inch (psig)] upon release of such deforming force.

Depending from the outer periphery of top section 21 is skirt 22 having a snap-fitment rib 25 formed about its lower inner periphery. The depending skirt 22 and its snap-fitment rib 25 are sized so as to permit the resilient top 20 to be snapped into locking relation with the recessed portion 52 and its snap-fitment groove 54 of tubular portion 51. As will be seen, the seal along the connection of resilient top 20 and container body 50 should be substantially fluid-tight at the dispenser operating pressures for proper operation of the subject dispensing package. The described snap/lock connection arrangement is shown only as an example, as the container body 50 and resilient top 20 can be molded as one piece, obviating the need for such a seal, or attached by a plethora of alternative methods such as by threads, spin-welding or adhesives.

A dispensing passageway 23 is formed through the depending skirt 22 and extends radially outwardly through the interior of tubular protuberance 28. Circumscribing and radially spaced from the outer surfaces of protuberance 28 is an outwardly extending circumscribing retaining wall 26. Both the protuberance 28 and the circumscribing retaining wall 26 are concentrically aligned about a common central axis which is substantially perpendicular to the central axis of container body 50. Tubular protuberance 28 and the circumscribing retaining wall 26 are connected at their proximal ends by the outlet base ring 24. Formed about the inner periphery of the distal edge of the retaining wall 26 is retention rib 27, which extends inwardly towards the outer surface of protuberance 28.

The self-sealing dispensing outlet 30 can comprise any check valve which permits extrusion of product outwardly in response to product pressure within the dispenser and provides for clean cut-off and sealing on release of such pressure. The particular embodiment shown is preferably molded of silicone rubber (e.g. Silastic ®MDX 4-4526 available from Dow-Corning of Midland, Mich.), although a wide variety of materials (such as any resilient plastic or elastomer) and molding procedures can be used. The outlet 30 is shown in FIG. 1 as comprising four leaves or flutes 31, however, it is contemplated that alternate outlets with varying structures and number of leaves can be successfully utilized to provide a check valve and a self-sealing closure for the dispensing package. As can best be seen in the cross-sectional view of FIG. 2, the dispensing outlet 30 is formed with a generally cylindrical open inlet end 32 and an outlet end which terminates in interconnecting closed slits 33 intermediate the individual flutes 31. Outlet 30 is preferably formed with wall thicknesses of approximately 0.76 mm (0.03 inches) in its cylindrical open end 32 and 0.51 mm (0.02 inches) in its flutes 31. An attachment flange 34 is integrally formed at the bottom edge of open end 32 and extends outwardly in a plane substantially perpendicular to the central axis of outlet 30. It is preferred that outlet 30 be molded with the flutes 31 closed at their distal end, and thereafter cutting the slits 33 as desired to insure that such slits 33 will have the capability to fully close. The ability to close is important because outlet 30 must be capable of preventing flow of fluid into the dispenser package.

Outlet 30 is mounted onto dispensing package 10 by telescoping its cylindrical open end 32 over protuberance 28, and is positively held in place by a retaining ring 40 which slides over the exterior of outlet 30 and is snapped past the inwardly extending retention rib 27 of retaining wall 26. Retaining ring 40 is preferably made of polypropylene or polyethylene, but can be made of any relatively rigid material. The dimensions of retaining ring 40 and the location of the rib 27 are such as to insure that upon its application the ring 40 will be biased against flange 34, thereby establishing a tight seal of flange 34 against the outlet base ring 24. The manner of attachment of outlet 30 to the package is not critical, however, and can be accomplished in a variety of ways known or conceivable by those skilled in the art, such as by adhesives, spin-welding, or other mechanical arrangements. Although it is preferred for product cutoff and mess control that outlet 30 be attached externally (i.e., at the distal end of dispensing passageway 23 as shown) it is conceivable that in particular executions of the present invention it might be desirable to attach outlet 30 internally adjacent the discharge passageway (e.g. within an extended outlet channel).

A one-piece follower piston 70 preferably made of polypropylene or polyethylene (although any resilient material will suffice) is slidingly mounted within the container body 51 of dispensing package 10, as shown in FIG. 2.

In the embodiment shown, piston 70 exhibits a substantially flat face 76 integrally attached about its outer periphery to a depending sidewall 73. Extending outwardly and upwardly about the uppermost outer periphery of sidewall 73 is the peripheral contact band 78. A second peripheral contact band 78 is also shown extending outwardly and downwardly about the outer lower periphery of sidewall 73. The peripheral contact bands 78 conform to the shape of a cross section of the bore of tubular portion 51 and are dimensioned such that their outer diameter is slightly larger than the inside diameter of the bore to provide an interference fit within the bore which exerts a predetermined normal force against its inner surfaces in static condition. This predetermined normal force establishes frictional resistance to movement of piston 70 within the bore. By designing for a predetermined amount of interference between the contact bands 78 and the inner surfaces of the bore of tubular portion 51, a predetermined frictional resistance to movement of the piston within the bore can be established for a given material (or materials) making up the piston and the bore. As used herein, the term "frictional resistance" is the amount of force which must be exerted on the face 76 of piston 70 to initiate movement of piston 70 within the bore.

In a preferred execution, piston 70 exhibits face and sidewall thicknesses of approximately 1.27 mm (0.05 inches) and thickness of its contact bands 78 tapering from approximately 0.76 mm (0.03 inches) at their proximal edges to approximately 0.51 mm (0.02 inches) at their distal edges. In order to establish the predetermined amount of frictional resistance of piston 70 to both upward and downward displacement within container body 50, piston 70 is formed with an outside diameter of its contact bands 78 approximately 0.64 mm (0.025 inches) larger than the inside diameter (which in a preferred embodiment is approximately 41.3 mm or 1.625 inches) of the bore of tubular portion 51. Such intentionally oversized dimensions provide an interference fit which develops normal forces exerted by the resilient piston 70 against the inner walls thereby establishing the predetermined frictional resistance to movement of piston 70 within the container body 50. In addition to establishing frictional forces between piston 70 and container body 50, contact bands 78 more importantly serve to provide seals against leakage of the fluid product contained past piston 70. Such fluid tight seals also serve to insure that ambient fluids cannot enter package 10 past piston 70.

While it is preferred that piston 70 be formed with two longitudinally spaced contact bands 78 as shown and described, pistons made in accordance with the present invention can have as few as one peripheral contact band 78. The second contact band 78 is preferably included as it augments the sealing capabilities of piston 70, helps attain the predetermined frictional resistance to movement of piston 70, and helps prevent misalignment of piston 70 within container body 50 during operation of the dispenser (which will be described in detail below). It is important that piston 70 remain properly aligned within container body 50 in order to insure proper sealing of the dispenser and maintenance of the predetermined frictional resistance to movement of piston 70. While two or more peripheral contact bands 78 can be utilized to prevent misalignment of piston 70 within container body 50, any means of insuring proper alignment of piston 70 can be used. For example, it is contemplated that a piston having only one peripheral contact band 78 about its upper portions and having a depending sidewall 73 with an outside diameter only slightly smaller of the inside diameter of the bore of tubular portion 51 would have no misalignment problems.

The predetermined frictional resistance to movement of piston 70 within the bore is substantially equivalent in both upward and downward directions of axial movement within the bore. Because piston 70 is not required to exhibit preferential resistance to movement in either the upward or downward axial direction, the piston's design and manufacture are greatly facilitated by the simplicity of the resulting structure. While the piston designing procedure is simplified by the removal of a preferential resistance requirement, the frictional resistances need not be exactly equal in both directions either. It has been found that the designing of a piston with exactly equal resistances in both directions requires nearly as much effort as does designing a piston with preferential resistances. One of the advantages of the present invention is that its pistons need not exhibit a preferential resistance, and that any simple piston with substantially equivalent resistances to displacement within the bore will function properly. Piston 70 as shown in FIG. 2 and described above, for example, exhibits resistances of approximately 1.97 kg (4.35 lbs.) to upward movement and approximately 1.79 kg (3.94 lbs.) to downward movement. It is preferred that such frictional resistances be within a range of approximately plus or minus twenty five percent (±25%) of one another. Such a range facilitates designing and takes into account machine tolerances and variations inherent in high speed mass production. As will be discussed below, simply affixing the piston face 76 in a more central location within piston 70 would result in more closely equalized frictional resistances of the piston. It is preferred, however, to locate face 76 on the upper portions of piston 70 to insure more complete dispensing of all the product within package 10.

Package 10 is preferably initially partially assembled in the manner described, omitting the piston 70. The partially assembled package 10 is then inverted and bottom-filled with product, leaving sufficient unfilled space in the open end of the bore of container body 50 for piston 70 to thereafter be fully inserted therein.

In operation, the rounded section 21 of resilient top 20 is manually depressed, thereby decreasing the volume within the dispensing package and resulting in a pressure rise in the product therein. Pressure changes within the dispensing package are transferred through the mass of fluid product housed therein and exerted on the piston face 76. As described above, the self-sealing dispensing outlet 30 permits extrusion of product outwardly at a desired rate of flow when the product pressure within the dispenser attains a predetermined required dispensing pressure. The permit pressure within the dispensing package to attain this required dispensing pressure, the frictional resistance to movement of piston 70 in the downward axial direction must be greater than the force applied to said piston by such required dispensing pressure. Designing piston 70 to exhibit a predetermined frictional resistance to movement greater than the force applied to the piston by the dispensing pressure required in a particular dispensing package thereby permits the product to be dispensed without downward movement of piston 70 within the container body 50. In the described embodiment, the required dispensing pressure will be the sum of the pressure drop required to extrude the fluid product housed in the container through the relatively small passageway 23 (which in a preferred embodiment is approximately 6.4 mm or 0.25 inches in diameter), plus the pressure required to open the flutes 31 of dispensing outlet 30, plus the pressure required to push the product through the flutes 31 at a desired rate once opened. The required dispensing pressure for any particular dispensing package can, therefore, be predetermined and controlled by varying the size of dispensing passageway 23 and/or the functional properties of the dispensing outlet 30, while taking into consideration the viscosity of the product to be dispensed and the desired rate of dispensing. As used herein, the term "required dispensing pressure" is used to connote the pressure within the dispenser required to dispense the contained product at a desired flow rate. For example, the dispensing pressure required in the described embodiment is approximately 0.11 kg/cm$^2$ [1.5 lbs. per square inch (psig)] when a fluid product of 300,000 cp (Brookfield) viscosity is housed therein and the desired dispensing flow rate is approximately 1.45 to 2.9 cc/sec.

When the pressure within the dispensing package 10 reaches the required dispensing pressure at the dispensing passageway 23, product will dispense outwardly at the desired flow rate and such dispensing will continue until the pressure in the dispenser falls below that required pressure. Upon release of the force depressing top 20, pressure within the dispensing package begins to drop as the resilient top 20 returns toward its original position. When such internal pressure approaches atmospheric pressure, the outlet 30 will tend to close due to the elastic memory of its material. As the resilient top 20 continues to move toward its original position, a partial vacuum is established within the dispensing package 10. Such negative pressure causes atmospheric pressure to act upon the exterior surfaces of the leaves 31 of outlet 30, sealing the slits 33 and thus closing the nozzle in a substantially fluid-tight condition. The partial vacuum within the package 10, therefore, obtains no substantial relief through the outlet 30 or through the seals between the contact bands 78 and the inner wall surfaces of tubular portion 51, which are capable of preventing the entry of ambient air into the dispensing package. In the preferred embodiment, the 0.64 mm (0.025 inches) of interference fit between the contact bands 78 of piston 70 and the inner diameter of tubular portion 51 insures an adequate fluid-tight seal. Other means of providing a seal of said piston 70 within the container body 50 could be equally successfully employed. It is preferred, however, for simplicity of design to utilize the contact bands 78 to both establish the predetermined frictional resistance to movement of piston 70 and to provide a fluid-tight seal of piston 70 within container body 50.

The imbalance of pressure which acts upon the piston face 76 (i.e. the vacuum acting on the upper surface and atmospheric pressure on the lower surface) imposes an effective upward force thereon. The predetermined frictional resistance to movement of piston 70 within the bore must be less than the force applied to said piston by the pressure imbalance so that when product pressure within the dispenser is reduced to below atmospheric (but above an absolute vacuum), such pressure imbalance will move piston 70 toward the upper end of the bore. Resilient top 20 must be capable of creating such pressure imbalance. Piston 70 is thereby displaced upwardly a distance generally corresponding to the volume of the charge of fluid product dispensed, acting to relieve the partial vacuum created by the recovery of resilient top 20, at which point equilibrium is reached by achieving a rough balance involving the opposing pressures and the system's resistance to further piston movement. The dispensing package 10 is now ready for another dispensing operation.

It should be noted that should the required dispensing pressure be exceeded (e.g., by dropping the package or by overzealous actuation) during a dispensing operation and the pressure is sufficient to exert a force on the piston exceeding its predetermined frictional resistance to movement, the product will continue to be dispensed, but the piston will be displaced in a rearward direction. When the overload is removed, however, the system will recover equilibrium because no air has entered the package (i.e., due to the fluid tight seals of package 10, any overload is reversible).

Figure 3:
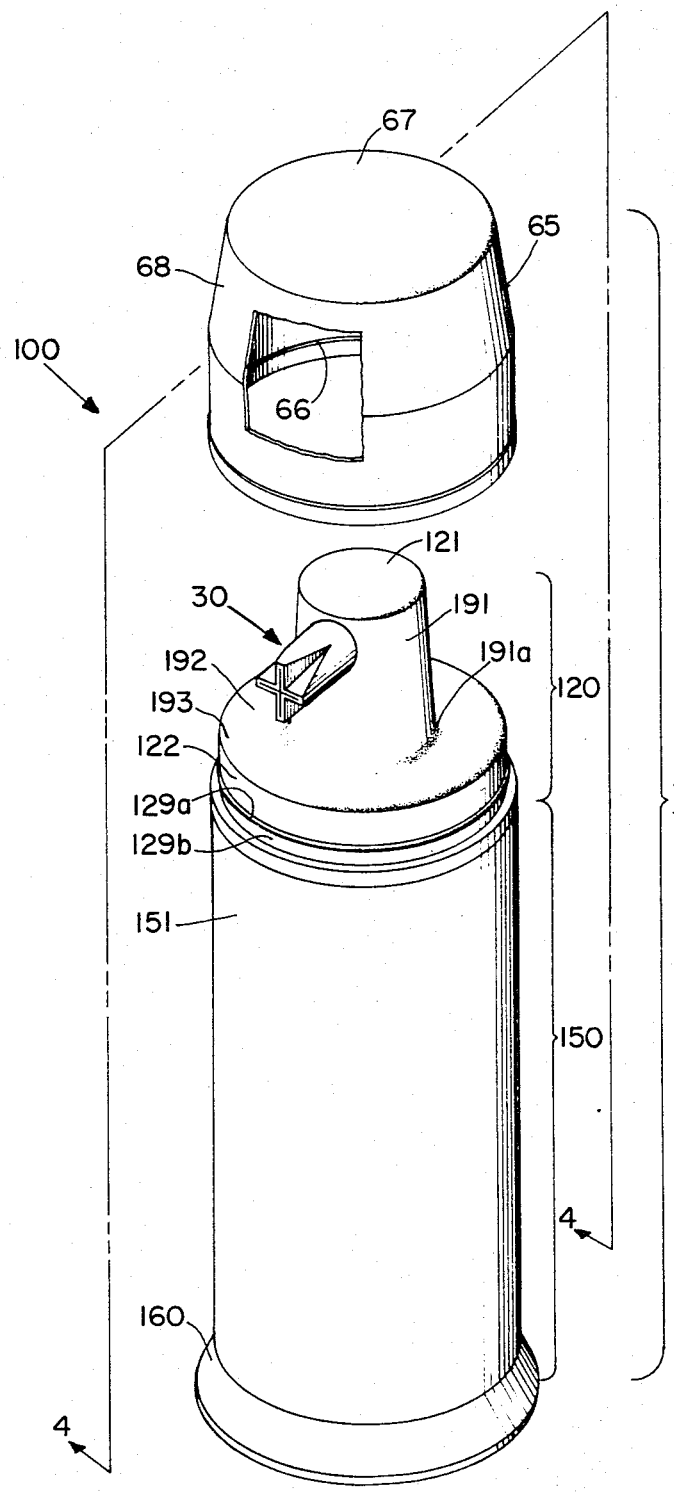
FIG. 3 is a partially exploded perspective view of a second preferred embodiment of the dispenser of the present invention.
Figure 4:
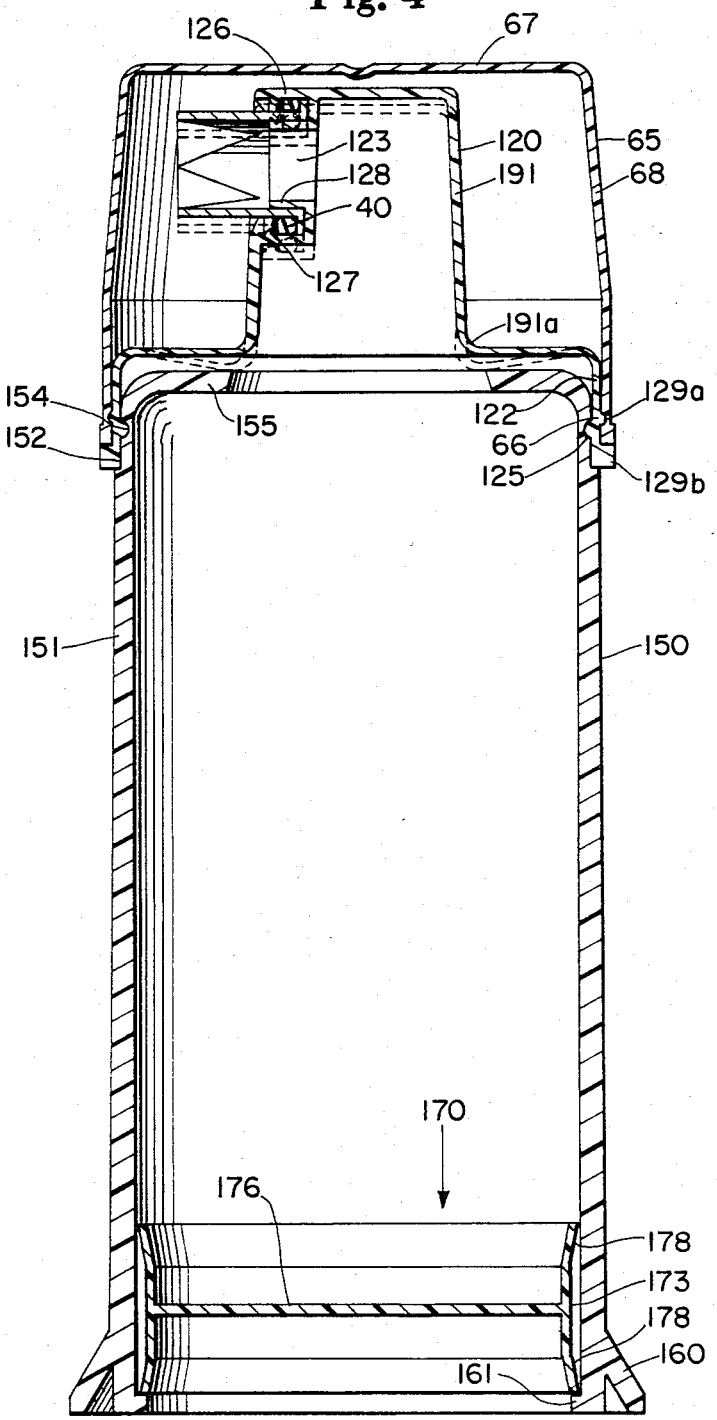
FIG. 4 is an enlarged vertical cross-sectional view of said second preferred embodiment of FIG. 3 taken along the line 4—4.

FIGS. 3 and 4 illustrate an alternate and equally preferred embodiment of the subject dispensing package. Paricularly, FIGS. 3 and 4 illustrate a dispensing package 100 comprising the container body 150 for housing a mass of fluid product to be dispensed, a resilient dispensing top 120, a self-sealing dispensing outlet 30, a follower piston 170 and an overcap 65. As is apparent from the drawings, container body 150 is substantially similar to container body 50 as described above. The tubular portion 151, recessed portion 152, snap-fitment groove 154, and base 160 correspond exactly to parts 51, 52, 54 and 60, respectively, of the first described embodiment. A support wall 155 extends inwardly from the upper inner surfaces of the bore of tubular portion 151 and partially closes the uppermost end of container body 150. A plurality of piston stops 161 are integrally formed in spaced relation about the lowermost inner periphery of container body 150, and comprise generally rectangular protuberances extending inwardly a relatively short distance toward the central axis of container body 150. Piston stops 161 are shown simply as an example of means for initially insuring the retention of piston 70 within the container body 150 during shipping and initial use. Similar piston stop means could also be incorporated into the dispensing package 10 described above. Overcap 65 is of generally cup-like shape and comprises a substantially flat circular top portion 67, a depending sidewall 68, and snap-fitment groove 66 formed about the lower inner periphery of sidewall 68.

The resilient dispensing top 120 is an integral structure and comprises a rigid button top 121, a depending cylindrical button wall 191, rounded base **191*a*, concentric diaphragm or horizontal spring 192, a substantially rigid shoulder area 193, and the rigid skirt 122. Dispensing top 120 is preferably molded of polypropylene having a thickness of between 0.44 and 0.51 mm (between 0.017 and 0.020 inches) in its horizontal spring 192, and slightly thicker in the balance of its structure. The thickened areas are designed to remain rigid throughout a dispensing operation while the thinner spring 192 deflects thereby varying the interior volume of package 100. As shown in FIG. 4, snap-fitment rib 125 is formed on the lower inner periphery of depending skirt 122 to engage in a fluid-tight snap fitment with upper recessed portion 152 and the snap-fitment groove 154 of container body 150. This snap-fitment arrangement, as well as the corresponding arrangement described in the first embodiment above, are provided only as examples as other connecting means could alternatively be utilized, or the resilient dispensing top 120 and container body 150** could be unitarily molded, thus obviating a need for connection means.

A dispensing passageway 123 is formed through the cylindrical button wall 191 and comprises an outwardly extending tubular section 128, a circumscribing retaining wall 126, and a retention rib 127 extending inwardly about the inner surfaces of the retaining wall 126. Again, such arrangement is provided as an example for mounting the dispensing outlet 30 onto dispensing package 100, as many other methods for such attachment are available or conceivable by one skilled in the art. The self-sealing outlet 30 is identical to that same structure as described in the previous embodiment above.

Piston 170 illustrates a modified version of piston 70 as described above, wherein piston face 176 is attached about its outer periphery to the inner surfaces of sidewall 173. Contact bands 178 are identical to the contact bands 78 of piston 70. Because of the centrallized location of face 176, piston 170 exhibits substantially equal resistance to both upward and downward displacement within package 100. It is contempleted that piston 70, or any piston exhibiting a frictional resistance to displacement within dispensing package 100 which is substantially equivalent for both upward and downward axial movement, could be readily substituted for piston 170 herein.

Snap-fitment rib **129*a* extending outwardly from the periphery of skirt 122, and stop flange 129*b* similarly extending from the outer distal edge of skirt 122 are included as an example of means for attaching overcap 65 to the dispensing package 100. Snap-fitment groove 66 of overcap 65 lockingly interacts with rib 129*a* when overcap 65 is telescoped over dispensing top 120** into closed position.

The operation of dispensing system 100 is identical to that described above with regard to the dispensing system 10, with the exception of the manner in which the pressure of the dispensing system is to be varied. The resilient top 20 of dispensing system 10 and the resilient dispensing top 120 of dispensing system 100 are provided only as examples of finger activated means for varying the product pressure of the subject dispensing system. It is contemplated that many alternate structures for accomplishing such volume and pressure variation are available or conceivable by those skilled in the art. Particular executions of such pressure varying means can be designed to optimize the required force and/or stroke length necessary to provide a predetermined amount of pressure variance within a specific dispensing system. For example, such means might be designed to require a relatively large amount of axial displacement (stroke length) of a relatively small surface area to provide a predetermined pressure variance while requiring less axial force to facilitate its use by small children. The pressure varying means can therefore be a valuable tool in optimizing the functional characteristics of a dispensing system to correspond to customized usage and/or convenience considerations.

Again, package 100 is preferably partially assembled without piston 170 for bottom filling the product as described above with regard to package 10. Following such bottom filling, piston 170 is inserted into container body 150 and snapped past the piston stops 161. Piston stops 161 are shown only as an example of means to insure retention of piston 170 within package 100 during shipping, handling and initial use. In operation, downward manual force is imposed upon the button top 121 thereby axially depressing said button top 121 and the rigid cylindrical button wall 191 and causing inward deflection of the concentric diaphragm 192, as indicated by the dotted lines of FIG. 4. Such axial displacement of the resilient top 120 results in a volume reduction within the dispensing system 100 and causes pressure within said system to rise. As described in relation to the first embodiment, the follower piston 170 resists rearward displacement in response to such rising pressure and fluid product will be dispensed through the dispensing passageway 123 at the desired rate of flow when the internal pressure reaches the required dispensing pressure. It has been found that in some designs of the volume/pressure varying means, such as the resilient dispensing top 120, excessive downward force imposed thereon can cause irreversible deformation of said means. For example, excessive downward force upon the button top 121 of the embodiment 100 might cause excessive strain or catastrophic failure at the rounded base 191*a* of the wall 191 or in the vicinity of the peripheral shoulder 193, wich could render the entire dispensing system inoperable. One way to prevent such failure is to design into the dispensing system means for positively limiting the axial travel of the pressure varying means. An example of such a positive limitation means is illustrated in FIG. 4, which shows the support wall 155. The dotted lines in FIG. 4 illustrate the limiting effect of support wall 155 on the axial travel of dispensing top 120.

It has also been found that to prudently match the predetermined frictional resistance of the piston within the container, the volume (and pressure) varying capabilities of the volume varying means, and the pressure requirements for dispensing, viscosity and lubricity of the fluid product to be dispensed must be considered. Viscosity can substantially affect the pressure drop across the dispensing conduit and may also be key in determining the number and type of sealing means required for said piston to effectively operate and protect said fluid within the dispensing package. It has been observed that higher viscosity fluids tend to augment the reliability of the piston seals. Lubricity of a contained fluid and the inherent coefficient of friction of the material(s) used to construct the inner surfaces of the container bore and the piston logically tend to have a direct effect on friction values within the dispensing system, and such effects must be considered in the design requirements of each particular execution.

Various modifications and uses of the described invention in addition to those discussed above will be apparent to those skilled in the art. Accordingly, the scope of the present invention should be considered in terms of the following claims and is understood not to be limited to the details of structure and operation described and shown in the specification and drawings.

I claim:

1. A pump-type dispenser for a fluid product, comprising:

(a) a tubular container body having an axially extending bore for housing said fluid product, said container body having an upper end in direct communication with a discharge passageway and an open lower end;

(b) a check valve dispensing outlet located adjacent said discharge passageway, said outlet permitting said product to be dispensed outwardly therethrough at a desired rate of flow when product pressure within said dispenser attains a predetermined required dispensing pressure and sealing said passageway when the product pressure is reduced to atmospheric;

(c) finger activated pump means on said dispenser to raise the product pressure within said dispenser and displace a charge of product and, on release, to establish a vacuum within said dispenser which persists until volumetric equilibrium is established within said dispenser; and (d) a follower piston slidably mounted within the bore of said tubular container body and sealing the same against escape of product from said lower end, said piston being formed of resilient material and comprising a face portion and a peripherally attached sidewall, said piston face being in constant direct fluid communication with said check valve dispensing outlet, said sidewall being formed with a peripheral contact band conforming to the shape of the cross section of the bore and dimensioned to provide an interference fit within the bore which exerts a predetermined normal force against the inner surfaces of said bore in static condition thereby establishing a predetermined frictional resistance to movement of said piston within said bore, said frictional resistance being substantially equivalent in both upward and downward directions of axial movement within said bore, being greater than the force applied to said piston by said required dispensing pressure and less than that applied to said piston by pressure imbalance caused by the establishment of said vacuum within said dispenser, and being the sole means for inhibiting retrograde movement of the follower piston whereby upon application of pump pressure to said product said predetermined frictional resistance prevents movement of said piston toward the open end of said bore while allowing said required dispensing pressure to be attained within said dispenser for dispensing said product, and upon reduction of product pressure to below atmospheric permits ambient air pressure to move said piston toward the upper end of said bore a distance corresponding to the volume of said displaced charge of product thereby establishing volumetric equilibrium within said dispenser.

2. The pump-type dispenser of claim 1, wherein the sidewall of said follower piston is formed with a plurality of said peripheral contact bands.

3. The pump-type dispenser of claim 2, wherein said sidewall is formed with two peripheral contact bands, a first contact band integrally attached about the upper portion of said sidewall, and the second contact band longitudinally spaced from said first contact band and integrally connected about the lower peripheral portion of said sidewall.

4. The pump-type dispenser of claim 3, wherein said check valve dispensing outlet comprises an integral combination check valve and dispensing closure attached to said dispenser at the distal end of said discharge passageway.

5. The pump-type dispenser of claim 4, wherein said check valve dispensing outlet is located externally on said dispenser, and wherein said finger activated pump means comprises a resiliently deformable top integrally attached to the upper end of said tubular container body.

6. The pump-type dispenser of claim 5, wherein said resiliently deformable top further comprises a rigid button top integrally formed with a depending cyclindrical button wall having a concentric resilient horizontal spring formed about its base, said horizontal spring facilitating deflection of said resiliently deformable top.

7. The pump-type dispenser of claim 3, wherein said axially extending bore is substantially circular and exhibits an inside diameter of approximately 41.7 mm (1.64 inches) and the outside diameter of said peripheral contact bands is approximately 43 mm. (1.7 inches).

* * * * *